United States Patent [19]

Baake

[11] 4,156,893

[45] May 29, 1979

[54] PORTABLE LAMP

[75] Inventor: Karl A. Baake, Angola, N.Y.

[73] Assignee: K & H Industries, Inc., Angola, N.Y.

[21] Appl. No.: 787,315

[22] Filed: Apr. 14, 1977

[51] Int. Cl.[2] ..... F21S 3/00; F21L 23/00; F21L 7/00

[52] U.S. Cl. ..... 362/222; 362/164; 362/186; 362/376

[58] Field of Search ..... 362/164, 186, 221, 222, 362/223, 369, 376, 157

[56] References Cited

U.S. PATENT DOCUMENTS

| | | | |
|---|---|---|---|
| 2,718,587 | 9/1955 | Charleston | 362/222 |
| 2,874,270 | 2/1959 | Douglass | 362/222 |
| 3,136,489 | 6/1964 | Oharenlco | 362/222 |
| 3,140,054 | 7/1964 | Oharenlco | 362/223 |
| 3,564,234 | 2/1971 | Phlieger | 362/222 |
| 4,042,819 | 8/1977 | Dacal | 362/376 |

*Primary Examiner*—Samuel W. Engle

*Assistant Examiner*—Donald P. Walsh

*Attorney, Agent, or Firm*—Christel & Bean

[57] ABSTRACT

A portable electric lamp comprising a tubular transparent housing, a fluorescent lamp in the housing, an arrangement of sockets and starter connected in a circuit for supplying electric current to the lamp, and a removable elongated reflector element in the housing to which the lamp and current supplying arrangement are fixed for removal as a unit from the housing. The housing is closed at one end by a cap element and has a hand grip element adjacent the other end which has an end closure, and the cap and hand grip are of aluminum alloy or like material having relatively high thermal conductivity. The cap and hand grip are held in place by a plurality of tension rods spaced circumferentially and outwardly around the housing. Impact-absorbing protector rings are provided on the end cap and hand grip and also on the tension rod assembly. The lamp ballast is connected in the electric power supply line in spaced relation to the lamp housing.

13 Claims, 8 Drawing Figures

PORTABLE LAMP

BACKGROUND OF THE INVENTION

This invention relates to the art of electric lamps, and more particularly to a new and improved portable electric lamp of explosion-proof construction.

One area of use of the present invention is in illuminating mines and similar work environments containing explosive gases although the principles of the present invention can be variously applied. Portable work lamps or extension lamps must be of explosion-proof construction to satisfy safety requirements of mines and other hazardous working areas. In particular, such lamps should be adequately enclosed or sealed against entry of explosive gas, should be of a construction which limits or confines any internal explosion and its effects in the event that one does occur in the lamp, and should withstand impacts and shocks which occur in dropping and bumping of the lamp. Along with satisfying these and other safety requirements, it is desirable to provide such a lamp which is portable, light in weight, easy to use in confined areas, provides adequate illumination and is simple in construction and easy to maintain.

SUMMARY OF THE INVENTION

It is therefore, a primary object of this invention to provide a new and improved portable electric lamp.

It is a further object of this invention to provide such a lamp which is of explosion-proof construction.

It is a more particular object of this invention to provide such a lamp which has a sealed construction preventing entry of gas to the internal electrical components of the lamp.

It is a more particular object of this invention to provide such a lamp of a construction which limits or confines any explosion and effects thereof which might happen to occur within the lamp.

It is a further object of this invention to provide such a lamp which is resistant to impact and similar shocks.

It is a further object of this invention to provide such a lamp which gives adequate illumination and is easy to use in confined spaces.

It is a further object of this invention to provide such a lamp which is relatively simple in construction and easy to maintain.

The present invention provides a portable electric lamp comprising an elongated housing having a light-transmitting portion, an elongated electric lamp within the housing, means for supplying electric current to the lamp, and a removable elongated reflector element in the housing to which the lamp and current supplying means are fixed for removal as a unit from the housing. The housing is sealed closed at one end by a closure element and at the other end by a hand grip element having a closure portion, and the end closure and hand grip elements are of a material having relatively high thermal conductivity. The end closure and hand grip elements are drawn tightly against opposite ends of the housing by a plurality of tensioning rods spaced around the housing. Impact-absorbing protector elements are provided on the end closure and hand grip elements and also on the tensioning rod assembly. A ballast element is provided in the electric power supply line in spaced relation to the lamp housing.

The foregoing and additional advantages and characterizing features of the present invention will become apparent upon a reading of the ensuing detailed description together with the included drawing wherein:

BRIEF DESCRIPTION OF THE DRAWING FIGURES

FIG. 1*a* is a fragmentary, longitudinal cross-sectional view through a lamp according to the present invention proceeding from the hook end and terminating at an arbitrary location between the ends of the lamp;

FIG. 1*b* is a continuation of the section of FIG. 1*a* and terminating at a location along the electrical power cord leading away from the opposite end of the lamp;

FIG. 1*c* is a continuation of the section of FIG. 1*b* and showing the electrical ballast for the lamp;

FIG. 2 is an elevational view of the lamp of FIG. 1 taken from the hook end thereof;

DETAILED DESCRIPTION OF THE ILLUSTRATED EMBODIMENT

Portable electric lamps of the type used in mines and other work areas characterized by confined spaces are of a basic construction including an elongated fluorescent lamp within an elongated, for example tubular, enclosure or housing of light-transmitting material and an electrical circuit arrangement including sockets in the enclosure for supplying electrical current to the lamp. The housing is closed at both ends and can be provided with a hook on one end and a handle or hand grip element adjacent the opposite end.

In accordance with the present invention, one of the end closure elements is removably connected to the lamp housing, and an elongated supporting and reflecting element is removably held in the housing, the fluorescent lamp and current supply arrangement being fixed to the supporting and reflecting element. As a result, the lamp, current supplying arrangement and supporting and reflecting element can be withdrawn as a unit from the housing upon removal of the end closure element. The closure element at one end of the housing and the hand grip element adjacent the other end of the housing both are of a material having relatively high thermal conductivity, for example an aluminum alloy. This results in rapid dissipation of heat from any explosion which might happen to occur within the lamp thereby limiting and confining any such explosion. A plurality of tensioning rod elements are spaced circumferentially and outwardly of the lamp housing, and each rod is connected at opposite ends to the end closure element and hand grip element drawing or tightening the elements against opposite ends of the housing. The tension rods also are of material having relatively high thermal conductivity. A protector element of impact-absorbing material and preferably annular in shape is carried by the end closure element. At least one protector element, preferably two, also is carried on the hand grip elements. The outer dimension or perimeter of each protector element is greater than the outer dimensions of the closure and hand grip elements and of the tension rod assembly. At least one protector element of impact absorbing material and preferably annular in shape is carried by the tension rod assembly, the outer dimension or perimeter thereof is less than that of the protector elements on the end closure and hand grip elements, the outer surface thereof is located outwardly of the tension rod elements, and the inner surface thereof is spaced outwardly of the housing. An electrical ballast for the fluorescent lamp is located in spaced relation to the lamp housing.

Figure 1A:
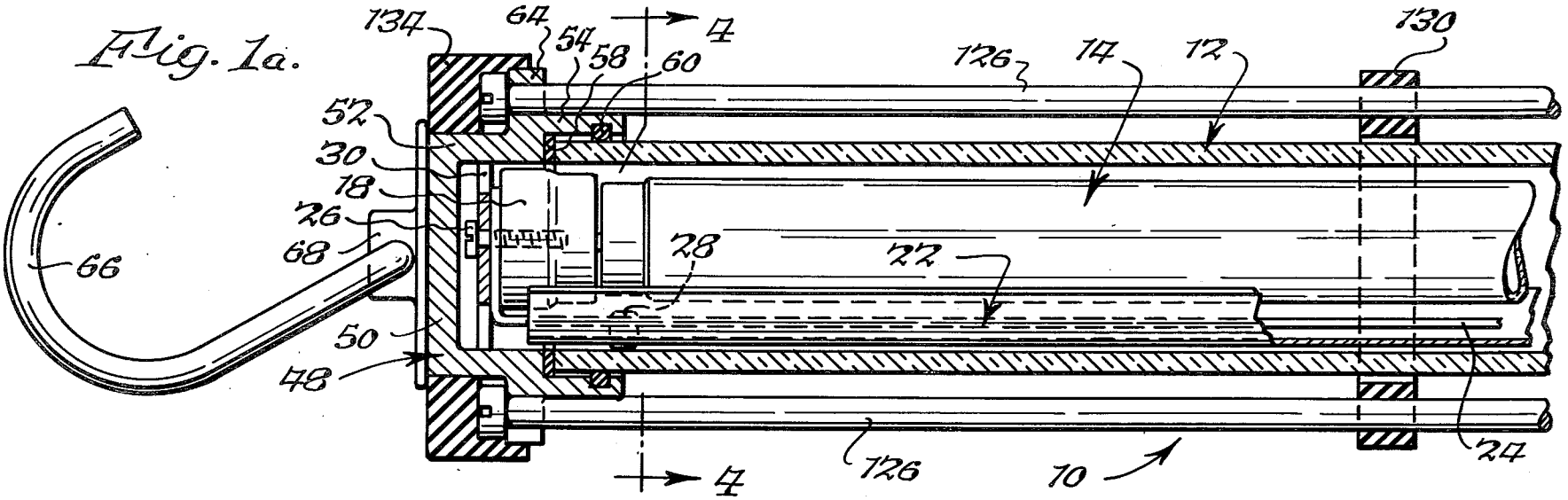
Figure 1B:
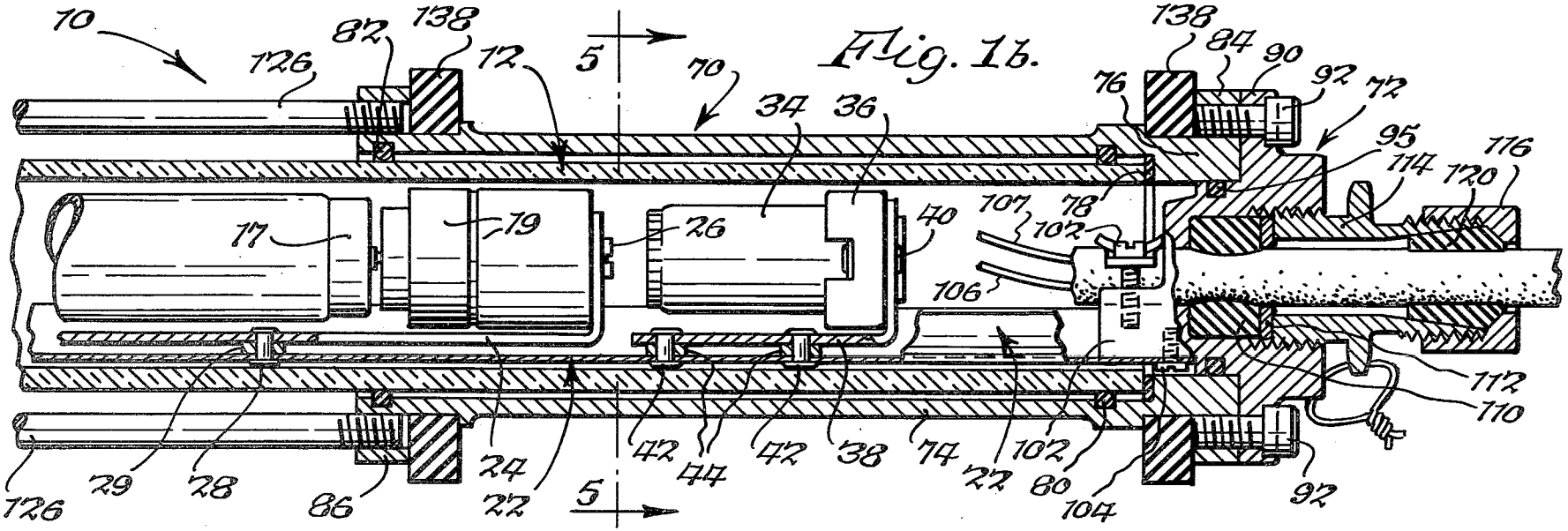
Figures 1C, 3, 4, 5, 6, 7:
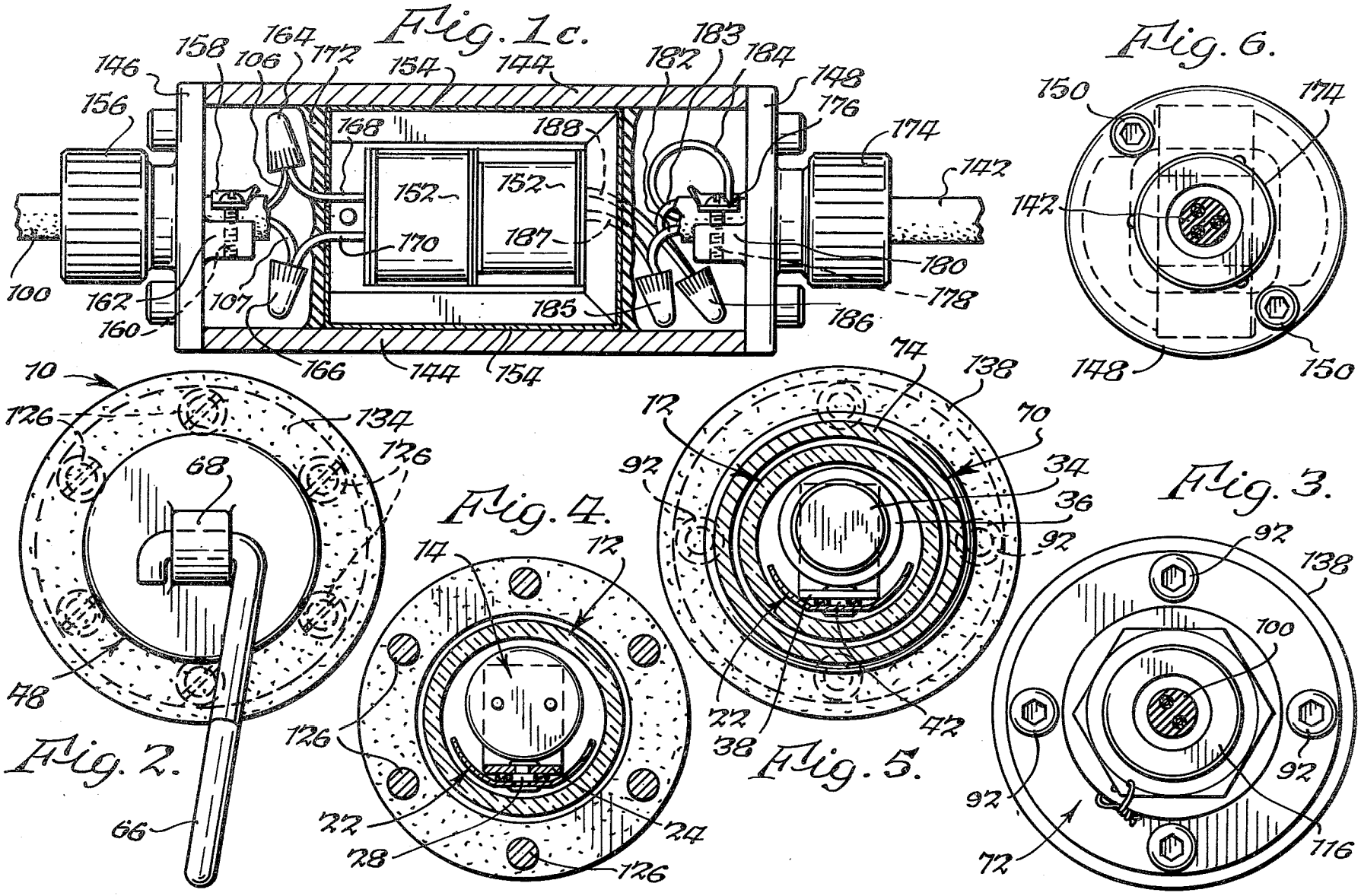
FIG. 3 is an elevational view, partly in section, of the lamp of FIG. 1 taken from the opposite end thereof.
FIG. 4 is a sectional view taken about on line 4—4 and FIG. 1*a;*
FIG. 5 is a sectional view taken about on line 5—5 of FIG. 1*b.
* and FIG. 6 is an elevational view, partly in section, of one end of the ballast of FIG. 1*c.*

Referring now to FIGS. 1*a* and 1*b*, an explosion-proof portable lamp according to the present invention includes a hollow, elongated housing 12 which preferably is cylindrical and which is of light-transmitting material such as Pyrex. A conventional fluorescent lamp 14 of cylindrical shape is contained within the tubular housing 12, and lamp 14 has standard pronged connector elements 16, 17 at opposite ends thereof. The connectors of the lamp 14, in turn, are removably connected in standard fluorescent lamp socket elements 18 and 19, respectively. The combination or assembly including lamp 14 connected between the sockets 18, 19 is carried by an elongated supporting means in the form of reflector element 22. Reflector element 22 is of suitable light-reflecting material, preferably metal with a surface polished or coated to be highly reflecting, and the reflector 22 has an overall length substantially equal to the axial length of the tubular housing 12. As shown in FIGS. 4 and 5, the reflector element 22 is generally arcuate in cross section, having an arcuate length so as to be somewhat less than semi-circular. The central portion of reflector 22 is generally planar to facilitate mounting of various elements thereto in a manner which now will be described.

An elongated, unitary mounting bracket is provided having a length substantially equal to the overall length of the combination of lamp 14 and starter elements 18, 19. Bracket 24 has a longitudinal main body portion and a pair of relatively short arm portions at substantially a right angle thereto and disposed in generally parallel planes. The sockets 18 and 19 are fixed to corresponding ones of the arms of flanges of the mounting bracket 24 by means of fastening screws designated 26. The main body portion of bracket 24 is disposed along and spaced from reflector element 22 and is fixed thereto in spaced relation by rivets 28 and spacer elements or washers 29 as shown in FIGS. 1*a* and 1*b*. In the portable lamp shown, the outer end of socket element 18 projects a small axial distance beyond the end of reflector element 22, and a centering and shock absorbing element 30 is fixed to the end of the assembly, being held in place between the head of the fastening screw 26 and the bracket flange for a purpose to be described. A conventional fluorescent lamp starter element 34 also is carried by the reflector element 22 adjacent the socket element 19. In particular, the starter element 34 is removably connected into a socket or receptacle 36 in a conventional manner, and the socket 36 is fixed to one leg of a right angle mounting bracket 38 by means of a suitable fastener 40. The other leg of bracket 38 is fixed in spaced relation to reflector 22 by means of rivets 42 and cooperating spacer elements 44 in a manner similar to that of bracket 24.

The assembly of the lamp 14, sockets 18 and 19, reflector 22, starter 34 and socket 36, and brackets 24 and 38 is removably contained in the tube or housing 12 in the following manner. The tubular housing 12 is closed at one end, i.e. the left-hand end as viewed in FIG. 1*a*, by an end cap or closure element generally designated 48 of material having a relatively high thermal conductivity, preferably metal such as aluminum or aluminum alloy. The end cap 48 has a planar, disc-like base portion 50 disposed in a plane perpendicular to the longitudinal axis of tubular housing 12, a first cylindrical wall portion 52 extending axially from base 50 and having an inner diameter substantially equal to the inner diameter of the tubular housing 12, and a second cylindrical wall portion 54 extending axially therefrom and having an inner diameter slightly greater than the outer diameter of the tubular housing 12 thereby permitting the end of housing 12 to fit therein. The inner surfaces of the wall portions 52 and 54 meet an annular shoulder surface disposed in a plane perpendicular to the longitudinal axis of housing 12, and this provides an abutment or stop for the end face of the tubular housing 12. In this connection, the radial dimension of the shoulder surface is slightly greater than the radial dimension of the annular end face of housing 12. A seal element 58 is placed against the shoulder for contacting the end of tube 12, and the annular seal 58 is of a material providing an adequate glass-to-aluminum seal, for example a copper-asbestos gasket. The inner surface of wall portion 54 is provided with an annular groove a small distance axially inwardly of the outer end of cap 48 for receiving an O-ring 60 of rubber or similar material which serves as a centering guide and cushion for the assembly. The outer surface of housing 12 and inner surface of the cap wall portion 54 are spaced apart a small distance.

The centering and shock absorbing element 30 is received within the wall portion 52 and preferably element 30 has a series of radial extensions spaced around the periphery in a star-like formation. The outer ends of the formations contact the inner surface of the cylindrical wall portion 52. The inner diameters of cap wall portion 52 and housing 12 are substantially equal, and in this connection the wall portion 52 can be viewed as a continuation of the housing 12. The end cap element 48 also is formed with a radial flange or extension 64 located about midway along the axial length thereof and adjacent the axial location of the annular shoulder, and the extension 64 is employed in an arrangement for holding the cap element 48 in place in a manner which will be described. A generally C-shaped hook element 66 is movably connected to a fitting 68 extending from the outer surface of end cap 48 whereby the lamp can be hung from a suitable support during use or storage in a known manner.

The opposite end of the tubular housing 12 is received within a tubular handle or hand grip element 70, and the ends of handle 60 and housing 12 are closed by an end cap or closure element generally designated 72. Handle 70 is of a material having relatively high thermal conductivity, such as a metal like aluminum or an aluminum alloy. Handle 70 is generally cylindrical and includes a wall portion 74 having an inner diameter slightly greater than the outer diameter of the tubular housing 12, and the cylindrical wall 74 extends along substantially the entire axial length of handle 70. Adjacent the far right-hand end of handle 70 as viewed in FIG. 1*b* there is provided an enlarged wall portion 76 having an inner diameter substantially equal to the inner diameter of the tubular housing 12. The wall portions 74 and 76 meet in an annular shoulder disposed in a plane substantially perpendicular to the longitudinal axis of the housing 12. The shoulder serves as an abutment for the end of housing 12 and an annular seal element 78 is provided therebetween and is of a material providing an effective glass-to-aluminum seal such as a copper-asbestos gasket similar to the gasket 58. The inner surface of wall portion 74 of the handle is provided with annular grooves adjacent the opposite ends thereof for receiving O-rings 80 and 82 of rubber or like material thereby providing a cushioning mount between the handle 70 and tube 12. The inner surface of handle wall portion 74 and the outer surface of housing 12 are spaced apart a small distance. Handle 74 is formed at each end thereof with radial flanges or extending portions 84 and 86 for a purpose to be described.

The end cap element 72 is formed to include a radial flange or extending portion 90 having an outer diameter substantially equal to the outer diameter of handle flange 84, and cap 72 is attached to the end of handle 70 by means of screw-type fastening elements 92 extending through portions 84, 90. Flange 90, terminates in a flat annular surface disposed generally perpendicular to the longitudinal axis of tube 12, and this surface meets an inner axially outwardly extending surface having an outer diameter equal to or less than the inner diameter of the handle wall portion 76. An annular groove is provided in this axial surface for receiving an O-ring seal element 95.

The end cap or closure 72 is provided with and axially extending through passage 4 containing an electrical power cord or cable 100 for supplying electrical power to the starter, sockets and lamp in a known manner. As shown in FIG. 1*b*, cord 100 extends beyond the inner surface of end cap 72 whereby it is held in place by a cable clamp assembly designated 102 which is fixed to the end of the reflector element 22 by means of a fastening screw 104. The fastener 104 also serves to secure the end of reflector 22 to the inner end portion of closure element 72. The cable 100 includes two leads 106, 107 which are electrically connected to the sockets and starter in a known manner. In the axial passage through end cap 72 there is provided a packing element 110 generally in the shape of a relatively thick washer element of rubber or like material for providing a pressure-type packing around the cable 100. The packing element 110 serves to compress the cable 100 as shown in FIG. 1. A relatively thin washer-like element 112 is fitted on cable 100 axially adjacent the element 110. The passage has threads from the axial outer surface of closure 72 to about mid-way along the passage. A metal connector element 114 surrounds a portion of the cable 100 and has external threads on one end whereby it is connected into the passage of cap 72. The opposite, outer end of the connector 114 is externally threaded to receive an internally threaded cap or closure element 116. The inner diameter of the connector element 114 is relatively constant proceeding axially from the end connected in closure element 72. Adjacent the outer end of the connector 114 the inner diameter increases gradually to receive a cable strain relief bushing element 120 having an annularly tapered outer surface.

The overall assembly of housing 12, hand grip 70, and the end closure elements 48 and 72 are held together by a plurality of rod elements 126 located outwardly of housing 12, spaced around the periphery thereof, and which are fixed at opposite ends to end closure 48 and to hand grip 70. In particular, each rod 126 can be in the form of a tension rod provided with threads at one end and a screw type head at the opposite end. Axially aligned openings are provided circumferentially around the radial flange or extension 64 of end cap 48 and the radial flange or extension 86 of handle 74. During assembly, each rod thus is fitted through an opening in flange 64 and moved lengthwise along the housing 12 whereupon it is screwed into the corresponding aligned opening in the flange 84. By way of example, a total of six such rods is provided in a lamp assembly, and as the rods are tightened the end cap 48 is drawn against one end of the tubular housing 12 and the hand grip 70 and end closure 72 are drawn against the opposite end of the tubular housing 12. The tensioning rods 126 preferably are also of a material having relatively high thermal conductivity, preferably metal such as aluminum or aluminum alloy.

The portable lamp of the present invention further includes a plurality of protector elements of impact-absorbing material on the end closure 48 and hand grip element 70 and also carried by the rod elements 126. In particular, a protector element in the form of a ring 130 has an inner diameter slightly greater than the outer diameter of housing 12 so as to be spaced therefrom. Ring 130 is provided with a plurality of axially extending apertures therethrough which are located so as to receive corresponding ones of the rods 126 around the housing 12. The impact absorbing ring 130 has an outer diameter such that the outer surface thereof is beyond the rods 126. Ring 130 can be of rubber or any other suitable impact-absorbing material. A number of rings 130 can be provided in the assembly, carried on the rods 126, axially spaced along the portion of housing 12 between end cap 48 and the handle 74. Another protector element 134 is fitted on the end closure element 48 and likewise is of rubber or similar impact absorbing material. Element 134 is annular in shape, having an outer diameter which is greater than that of the end cap 48 and greater than that of the protector ring 130. Element 134 has an annular main body portion having an inner diameter equal to the outer diameter of the cap wall portion 52 and an axial end surface substantially perpendicular to the axis of housing 12. This axial end surface abuts against a relatively small annular shoulder on the outer axial end of cap 48 thereby preventing axial movement of element 134 in a left-hand direction as viewed in FIG. 1*a*. The main body portion of element 134 has an inner axial surface which abuts against the ends of tension rods 126 preventing axial movement of element 134 in a right-hand direction as viewed in FIG. 1*a*. This inner axial surface meets an axially extending flange portion of relatively small radial dimension which overlies a portion of the outer surface of flange 64 of cap 48.

The hand grip element 70 is provided with at least one protector element, and in the portable lamp shown there are two protector rings 138 adjacent the opposite ends of hand grip element 70. Each ring 138 has an inner diameter substantially equal to the outer diameter of hand grip element 70 so as to fit tightly thereon. One axial end face of each ring abuts the corresponding flange portion 84 or 86 of hand grip element 70, and the opposite axial end face of the ring abuts the corresponding small annular shoulder provided on the outer surface of hand grip 70. As a result, the rings 138 are fixed on hand grip 70 against axial movement. Each ring 138 has an outer diameter or perimeter which is greater than the outer perimeter of hand grip element 70 and greater than the perimeter of both closure elements 48 and 72. In addition the outer surfaces of the rings 138 are located outwardly of tension rods 126 and outwardly of the protector ring 130.

FIG. 1*c* illustrates the manner in which the ballast transformer is housed and isolated from the lamp and lamp housing 12. The ballast is connected electrically in the lamp power cord or cable between the cable portion 100 connected to the lamp and a cable portion 142 which connects to a standard electrical supply outlet when the lamp is in use. A ballast housing comprises a hollow, preferably cylindrical portion 144 of metal such as aluminum. The housing is closed by a pair of end closure elements 146, 148 which preferably are disc-shaped. The caps 146, 148 can be secured in place by suitable means, such as screw-type fasteners 150 shown in FIG. 6 which extend through the cap adjacent the periphery and into the wall of housing portion 144. A ballast transformer generally designated 152 is contained within a housing 154 of suitable metal which, in turn, is fitted in the housing portion 144. Cable portion 100 extends through an exterior hub portion 156 of cap 146 and is held in place by a clamp 158 secured by a screw 160 to an extension 162 on the inner surface of cap 146. Leads 106 and 107 extending from the end of cable 100 within the ballast housing are joined by connectors 164 and 166, respectively, to electrical leads 168 and 170 extending from transformer 152. Potting compound 172 is provided with housing portion 144 in contact with the left-hand end of the transformer assembly as viewed in FIG. 1*c*. Cable portion 142 extends through an exterior hub portion 174 of cap 148 and is held in place by a clamp 176 secured by a screw 178 to an extension 180 on the inner surface of cap 148. Cable portion 142 includes three leads 182, 183 and 184, and lead 184 serves as a neutral lead and is connected to clamp 176. Leads 182 and 183 extending from the end of cable 142 within the ballast housing are joined by connectors 185 and 186, respectively, to electrical leads 187 and 188 extending from transformer 152. Potting compound 189 is provided within housing portion 144 in contact with the right-hand end of the transformer assembly as viewed in FIG. 1*c*.

In use, the cable portion is connected to an electrical power, and lamp 14 is energized upon closing a manually-operated switch (not shown) associated with the lamp in a conventional manner. The user holds the portable lamp by means of hand grip 70 and disposes the lamp in a manner providing the desired illumination of a selected region. The portable lamp can be supported during use by means of hook 66, and reflector 22 directs and concentrates the illumination in a defined direction. Hook 66 also can be used to support the lamp when it is not in use.

The sealed construction of the portable lamp of the present invention makes it particularly desirable for use in regions containing combustible and explosive gases. The generally cup-shaped end closure 48 with a hollow wall portion overlapping the end of housing 12 together with gasket 58 and O-ring 60 provide a gas-tight seal which is enhanced by the action of the tensioning rods 126 in holding the end cap or closure and seals tightly and firmly in place at the end of the housing. Similarly, the overlapping relationship of hand grip element 70 on the opposite end portion of housing 12 together with gasket 78 and O-rings 80, 82 provide a gas-tight seal which is enhanced by the action of the tensioning rods 126 holding hand grip 70, closure 72 and the associated seals tightly and firmly in place at the end of the housing.

In addition to the enclosed arrangement which is sealed in a gas-tight manner, the assembly of lamp 14, sockets 18, 19, reflector 22 and starter 34 is removable as a unit from the lamp for convenient replacement of the lamp and starter. The screw fasteners 92 are removed, and the end closure 72 is grasped by hand to pull the aforementioned unit out of the housing 12, the reflector 22 being secured to closure element 72 as previously described. When the unit is reinserted in housing 12, this is facilitated by the centering element 30 which serves to guide the unit as it is moved along within the tubular housing. When the unit is in place, the centering element 30 also serves as a shock absorber as previously described as well as holding lamp 14 in spaced relation to the inner surface of housing 12. The end cap 72 is fitted in place and the fasteners 92 are installed.

The end closure 48 and hand grip element 70, and preferably also the closure portion 72 of the hand grip as well as tensioning rods 126, are of a material having relatively high thermal conductivity, preferably metal such as aluminum or suitable aluminum alloy. If, for example, the fluorescent lamp 14 should be broken during an accident and explosive gas or other material has managed to enter the enclosure despite the sealed arrangement described above, upon ignition of such explosive material by exposure to the heated electrode elements in the broken fluorescent tube, the explosion will be damped and extinguished immediately because of the heat conductive nature of the material in cap 48, hand grip 70 and closure 72, and also in the tension rods 126. The rapid dissipaof heat is expected to confine and stop the ignition-explosion before rupture of the enclosing housing provided by tube 12. An exemplary aluminum alloy is 356T6 as classified according to the Aluminum Association Standard.

The provision of the protector elements or rings 130, 134 and 138 renders the portable lamp of the present invention resistant to impact and similar shocks. The protector element 130, and preferably a plurality of such rings would be provided, is carried by the tension rods 126 in spaced relation to the Pyrex tube 12. If the lamp is dropped, the protector element 134 and the protector rings 138 will absorb or take up the initial shock or impact. If the protector ring 130 also strikes the surface causing the shock or impact, this ring 130 will absorb the impact force which also will be dissipated along the tension rods 126 in a manner avoiding breakage of tube 12 except under very unusual or extreme conditions beyond what normally should be expected.

Providing the ballast in spaced relation to the lamp and not a part of the lamp itself enhances the portability of the lamp and reduces its weight and at the same time reduces the number of electrical components in the lamp assembly which can be important on the matter of safety.

It is therefore apparent that the present invention accomplishes its intended objects. While a single embodiment of the present invention has been described in detail, this is done for the purpose of illustration, not limitation.

I claim:

1. A portable electric lamp comprising:

(a) an elongated, generally tubular housing having a light-transmitting portion;

(b) an elongated electric lamp within said housing;

(c) means for supplying electric current to said electric lamp;

(d) a closure element at one end of said housing, said element having a projecting portion adjacent said housing and of a perimeter greater than the perimeter of said housing, said element having a generally cylindrical wall portion axially overlapping a portion of the end of said housing, said wall portion being spaced a small distance outwardly of said housing, said closure element further including an inner substantially annular shoulder adapted to abut the axial end surface of said housing;

(e) flexible gasket means in sealing relation between said shoulder and said housing end surface and sealing means in sealing contact between said housing and closure wall portion;

(f) a hand grip element adjacent the opposite end of said housing and having a portion closing said housing end, said hand grip element having a projecting portion adjacent said housing and of a perimeter greater than the perimeter of said housing, said hand grip element being generally tubular and surrounding an axial portion of the opposite end of said housing, said hand grip element being spaced a small distance outwardly of said housing, said hand grip element further including an inner substantially annular shoulder adapted to abut the axial end surface of said housing;

(g) flexible gasket means in sealing relation between said shoulder and said housing end surface and sealing means in sealing contact between said housing and hand grip element;

(h) a plurality of tensioning rod elements spaced around said housing and disposed lengthwise thereof, each of said rod elements being connected at opposite ends to corresponding ones of said projecting portions of said closure element and said hand grip element, said rods drawing said closure element and hand grip element tightly against the corresponding opposite ends of said housing;

(i) a protector element of impact-absorbing material on at least one of said closure element and said hand grip element, said protector element having an outer surface of a perimeter greater than the perimeter of said closure element and greater than the perimeter of said hand grip element, said outer surface being located outwardly of said tensioning rod elements; and (j) at least one protector element carried by said tensioning rod elements, said protector element having an outer surface of a perimeter less than the perimeter of said first-named protector element, said outer surface of said protector element on said tension rods being located outwardly of said tensioning rod elements, said protector element on said tensioning rods having an inner surface spaced outwardly of said housing;

(k) whereby said protector element on said closure element or hand grip element absorbs the initial portion of any shock or impact and any remaining portion of the shock or impact is absorbed by said protector element on said tensioning rod elements and is dissipated along said rods.

2. Apparatus according to claim 1, further including another protector element of impact-absorbing material, there being a protector element on said closure element and a protector element on said hand grip element, each of said protector elements having an outer surface of a perimeter greater than the perimeter of said closure element and greater than the perimeter of said hand grip element, said outer surfaces being located outwardly of said tensioning rod elements and outwardly of the outer surface of said protector element on said tensioning rod elements.

3. Apparatus according to claim 2, further including another protector element on said hand grip element, said protector elements on said hand grip element being spaced lengthwise along said hand grip element, each of said protector elements having an outer surface of a perimeter greater than the perimeter of said hand grip element, said outer surfaces being located outwardly of said tensioning rod elements and outwardly of the outer surface of said protector element on said tensioning rod elements.

4. Apparatus according to claim 1, further including another sealing means in sealing contact between said housing and said hand grip element and spaced axially from said first-named sealing means associated with said hand grip element.

5. Apparatus according to claim 1, wherein said closure element and said hand grip element are of a material having relatively high thermal conductivity.

6. Apparatus according to claim 1, wherein at least one of said closure element and said hand grip element is removably connected to said housing and further including:

(a) elongated supporting means removably held in said housing; and (b) means for fixedly mounting said lamp and current supplying mean to said supporting means in a manner preventing substantial relative movement of said lamp and current supplying means lengthwise of said supporting means;

(c) whereby said lamp, current supplying means and supporting means can be withdrawn as a unit from said housing upon removal of said one closure element from the end of said housing.

7. Apparatus according to claim 6, wherein said supporting means comprises an elongated member positioned between said lamp and said housing, said member having a light-reflecting surface disposed toward said lamp and toward said light-transmitting portion of said housing, and means at each end of said elongated member for fixing said member in spaced relation to said lamp and housing.

8. Apparatus according to claim 7, wherein said housing and lamp each are cylindrical and in spaced relation with the longitudinal axes thereof in generally parallel and offset relation, and wherein said elongated member is disposed generally parallel to the longitudinal axes of said housing and lamp and has a generally arcuate cross section.

9. Apparatus according to claim 6, wherein said supporting means comprises an elongated member positioned between said lamp and said housing, said member being fixed at one end to the removable one of said closure and hand grip elements, and said member being fixed at the other end to a positioning and shock absorbing element comprising a body of flexible material having a shape and size providing contact with the inner surface of said housing.

10. Apparatus according to claim 6, wherein said positioning and shock absorbing element is of generally uniform thickness and has lateral dimensions significantly greater than said thickness, said element having outwardly projecting portions spaced circumferentially around said element, each of said projecting portions having contact with the inner surface of said housing.

11. Apparatus according to claim 1, wherein said electric current supplying means includes ballast means for said lamp, said ballast means being located outwardly of and spaced from said lamp housing.

12. Apparatus according to claim 5, wherein the portion of said hand grip element closing said housing end also is of a material having relatively high thermal conductivity.

13. Apparatus according to claim 1, wherein said tensioning rod elements are of a material having relatively high thermal conductivity.

* * * * *

UNITED STATES PATENT AND TRADEMARK OFFICE

CERTIFICATE OF CORRECTION

PATENT NO. : 4,156,893

DATED : May 29, 1979

INVENTOR(S) : Karl A. Baake

It is certified that error appears in the above-identified patent and that said Letters Patent are hereby corrected as shown below:

Claim 10, line 1, "claim 6" should be --claim 9--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*